US009697752B2

(12) United States Patent
Dovervik et al.

(10) Patent No.: US 9,697,752 B2
(45) Date of Patent: Jul. 4, 2017

(54) DEVICE WITH DATE OF FIRST USE INDICATOR, LABEL FOR INDICATING A DATE OF FIRST USE AND A METHOD OF RECORDING THE DATE OF FIRST USE OF A DEVICE

(71) Applicant: Liko Research and Development AB, Lulea (SE)

(72) Inventors: Elin Dovervik, Lulea (SE); Hanna Youngström, Kullavik (SE); John Eskilsson, Jonkoping (SE); Catherine Ringbjer, Lulea (SE); Åsa Lundström, Lulea (SE); Robert Alveblom, Pitea (SE)

(73) Assignee: Liko Research and Development AB, Lulea (SE)

( * ) Notice: Subject to any disclaimer, the term of this patent is extended or adjusted under 35 U.S.C. 154(b) by 162 days.

(21) Appl. No.: 14/597,485

(22) Filed: Jan. 15, 2015

(65) Prior Publication Data

US 2015/0221241 A1 Aug. 6, 2015

(30) Foreign Application Priority Data

Jan. 31, 2014 (EP) ..... 14153409

(51) Int. Cl.

| | |
|---|---|
| ***G09F 3/10*** | (2006.01) |
| ***G09F 3/02*** | (2006.01) |
| ***A61G 7/10*** | (2006.01) |

(52) U.S. Cl.

CPC ..... *G09F 3/02* (2013.01); *A61G 7/1051* (2013.01); *A61G 2205/00* (2013.01); *G09F 2003/0208* (2013.01); *G09F 2003/0282* (2013.01)

(58) Field of Classification Search

CPC ..... G09F 2003/0282; A61G 2205/00; A61G 2205/30

See application file for complete search history.

(56) References Cited

U.S. PATENT DOCUMENTS 3,270,453 A * 9/1966 Mitchell ..... G09F 3/14 40/305
3,537,194 A * 11/1970 Engle ..... G09F 3/10 156/91

(Continued)

FOREIGN PATENT DOCUMENTS

| | | |
|---|---|---|
| GB | 517 004 A | 1/1940 |
| JP | 2010 053482 A | 3/2010 |
| WO | WO2012/037608 A1 | 3/2012 |

OTHER PUBLICATIONS

EP Patent Search Report, dated Jun. 23, 2014, for Application No. 14153409.9-1651 (8 pages).

*Primary Examiner* — Kristina N Junge

(74) *Attorney, Agent, or Firm* — Barnes & Thonrburg, LLP

(57) ABSTRACT

A device includes a textile main body, and one or more indicator elements on the textile main body, or on a label fixed to the textile main body, for indicating date information. The indicator elements include a plurality of severable portions spaced from the main body or the label on which they are provided. Each of the severable portions is associated with date information such that by cutting one or more of the severable portions a date of use of the device or a date of inspection of the device is indicated. A device having indicator elements of this type has the advantage that the indication of a date of first use or a date of inspection can be made easily, can be read easily and will be durable over many laundry cycles.

16 Claims, 6 Drawing Sheets

(56) References Cited

U.S. PATENT DOCUMENTS

| | | | | |
|---|---|---|---|---|
| 4,936,606 | A * | 6/1990 | Moss | G09F 3/02 156/67 |
| 4,941,710 | A * | 7/1990 | Baymak | B60R 22/16 297/471 |
| 5,001,331 | A * | 3/1991 | Leestemaker | B23Q 41/00 235/375 |
| 6,289,534 | B1 | 9/2001 | Hakamiun et al. | |
| 2004/0021706 | A1* | 2/2004 | Lenthall | B65C 9/46 347/2 |
| 2008/0263919 | A1* | 10/2008 | Halliday | G09F 3/02 40/299.01 |
| 2010/0097181 | A1* | 4/2010 | Sorensen | A61G 7/10 340/10.1 |
| 2014/0115778 | A1* | 5/2014 | Ng | A61G 7/1015 5/83.1 |

* cited by examiner

DEVICE WITH DATE OF FIRST USE INDICATOR, LABEL FOR INDICATING A DATE OF FIRST USE AND A METHOD OF RECORDING THE DATE OF FIRST USE OF A DEVICE

CROSS-REFERENCE TO RELATED APPLICATIONS

The present application claims priority, under 35 U.S.C. §119(a), of European Application No. 14153409.9 which was filed Jan. 31, 2014 and which is hereby incorporated by reference herein.

BACKGROUND OF THE DISCLOSURE

The present disclosure relates to providing an indication of a date of first use or a date of inspection on a device and is particularly suited to devices that have a limited service lifetime, such as load bearing devices, and which are frequently washed.

This disclosure relates primarily, but not exclusively, to patient support devices such as slings, vests and lift sheets, such as those available from Liko AB of Luleå, Sweden. These devices are designed to support patients in use, and so it is desirable that they are strong enough to bear the load of any patient during their lifetime. A failure of one of these devices could possibly have consequences for the patient. To ensure that devices being used are robust enough, they are given a limited service lifetime, calculated based on an expected frequency of use, after which they are taken out of service. They are also inspected regularly for damage and wear and taken out of service early if appropriate.

Many different suggestions have been made on how to ensure that these devices are taken out of service at the appropriate time. But every solution requires a record of the date of first use of the device, and preferably a record of inspections that have taken place. One simple solution is to mark the device with a marker pen or with an attached clip with an indication of a date of first use or a date of end of service lifetime that caregivers can easily read before each use.

A problem with this approach is that the devices are washed frequently, typically every week, and sometimes after each use. Repeated washing means that markings or clips are worn off or washed away. It is then impossible to tell when the device was first used, when it was last inspected and when it should be taken out of service.

Another method that has been proposed is to cut a hole in the device or in a label attached to the device, or to cut off a portion of a label on the device, to provide an indication of a date of first use. While a hole cannot be washed off, it has been found that it can locally reduce the strength of the device or label which later causes the device or label to break. Breaking of the device or label is typically caused by the growth of a crack inevitably formed when using scissors in a fabric or plastic material. If the label breaks, then the record of the date of first use can be lost.

So there is a need for a means for recording a date of first use and dates of inspection of devices with limited lifetime that is simple to use, inexpensive, robust and reliable.

SUMMARY OF THE DISCLOSURE

In a first aspect, there is provided a device, the device comprising: a textile main body, and one or more indicator elements on the textile main body, or on a label fixed to the textile main body, for indicating date information, the indicator elements comprising a plurality of severable portions spaced from the main body or the label on which they are provided, each of the severable portions being associated with date information such that by cutting one or more of the severable portions a date of use of the device or a date of inspection of the device can be indicated.

A device having indicator elements of this type has the advantage that the indication of a date of first use or a date of inspection can be made easily, can be read easily and will be durable over many laundry cycles. By providing severable portions spaced from the main body of the device and any label on which the indicator elements are provided, severing the severable portions does not result in damage to the device or to the label and so does not affect the durability of the device or label.

The term "textile" as used herein covers fabrics, webbing, threads and fibers, including woven, knitted and non-woven textiles and may be taken to cover any flexible sheet material.

The one or more indicator elements may be woven into the textile main body or into the label. By weaving the indicator elements into the main body or label they are securely fastened in a manner that is durable over many laundry cycles. Alternatively, the indicator elements may be sewn, knitted or welded to the device or label.

Each of the indicator elements may comprise a plurality of threads. If a plurality of threads is used there is no problem if one thread breaks in the laundry process. Alternatively each of the indicator elements may be formed of a webbing material. The threads or webbing can be easily cut with a standard pair of scissors, which are typically available at any laundry facility/linen room/office where periodic inspection is made. The threads or webbing may be provided in a color that has high contrast with the underlying label or textile main body on which they are provided.

Each indicator element may comprise a plurality of severable portions, wherein each indicator element is fixed to the main body or the label between each of the severable portions. For example, each indicator element may be a plurality of parallel threads comprising fixing portions woven or sewn into the label, and a plurality of severable portions between the fixing portions formed by lengths of the threads that are not woven or sewn into the label. As an alternative, the fixing portions may be welded to the label or main body. The severable portions may be long enough to allow a blade of a pair of scissors to be inserted between the label and each of the severable portions. The indicator elements are sometimes fixed to the main body or to the label on which they are provided on opposite sides of each severable portion.

The device may further comprise a plurality of date markers, each severable portion being associated with a date marker so that cutting a severable portion provides an indication of a date. The date markers may be separate to and positioned adjacent to the severable portions. Alternatively, the date markers may be on, or part of, the severable portions.

In one embodiment, the date markers are woven into the textile main body or into the label on which the indicator elements are provided. This ensures that the date markers are durable over many laundry cycles.

The date markers may be numbers that indicate date information. The date markers may indicate any desired unit of time, such as months, years, weeks, days and quarters. In one embodiment at least one indicator element is associated with month information and at least one indicator element is associated with year information. In this embodiment, each severable portion is associated with a single month or year.

The device may further comprise a plurality of end of life markers, each end of life marker being associated with a date marker. This allows a user to quickly read the end of life date corresponding to a date of first use indicated by the cut severable portion or portions.

The device may be configured for bearing loads in use. For example, the device may be a patient support device, such as a sling, strap, vest or lift sheet.

In a second aspect there is provided a label for a load bearing device that is configured to be laundered a plurality of times, the label comprising a label backing sheet, one or more indicator elements on the label backing sheet for indicating date information, the indicator elements comprising a plurality of severable portions spaced from the label backing sheet, each of the severable portions being associated with date information such that by cutting one or more of the severable portions a date of first use of the device or a date of inspection of the device can be indicated.

In a third aspect there is provided a method for indicating a date of first use of a device, the device being in accordance with the first aspect of the disclosure, the method comprising: cutting one or more of the severable portions to provide an indication of the date of first use of the device or a date of inspection of the device.

It should be clear that features described in relation to one aspect can be used in other aspects of the disclosure. In particular, features described in relation to the device of the first aspect apply to the label of the second aspect. Other features of the disclosure will become apparent to those skilled in the art upon consideration of the following detailed description of illustrative embodiments exemplifying the invention as presently perceived.

BRIEF DESCRIPTION OF THE DRAWINGS

Embodiments in accordance with the disclosure will now be described, by way of example only, with reference to the accompanying drawings, in which.

DETAILED DESCRIPTION

Figure 1:
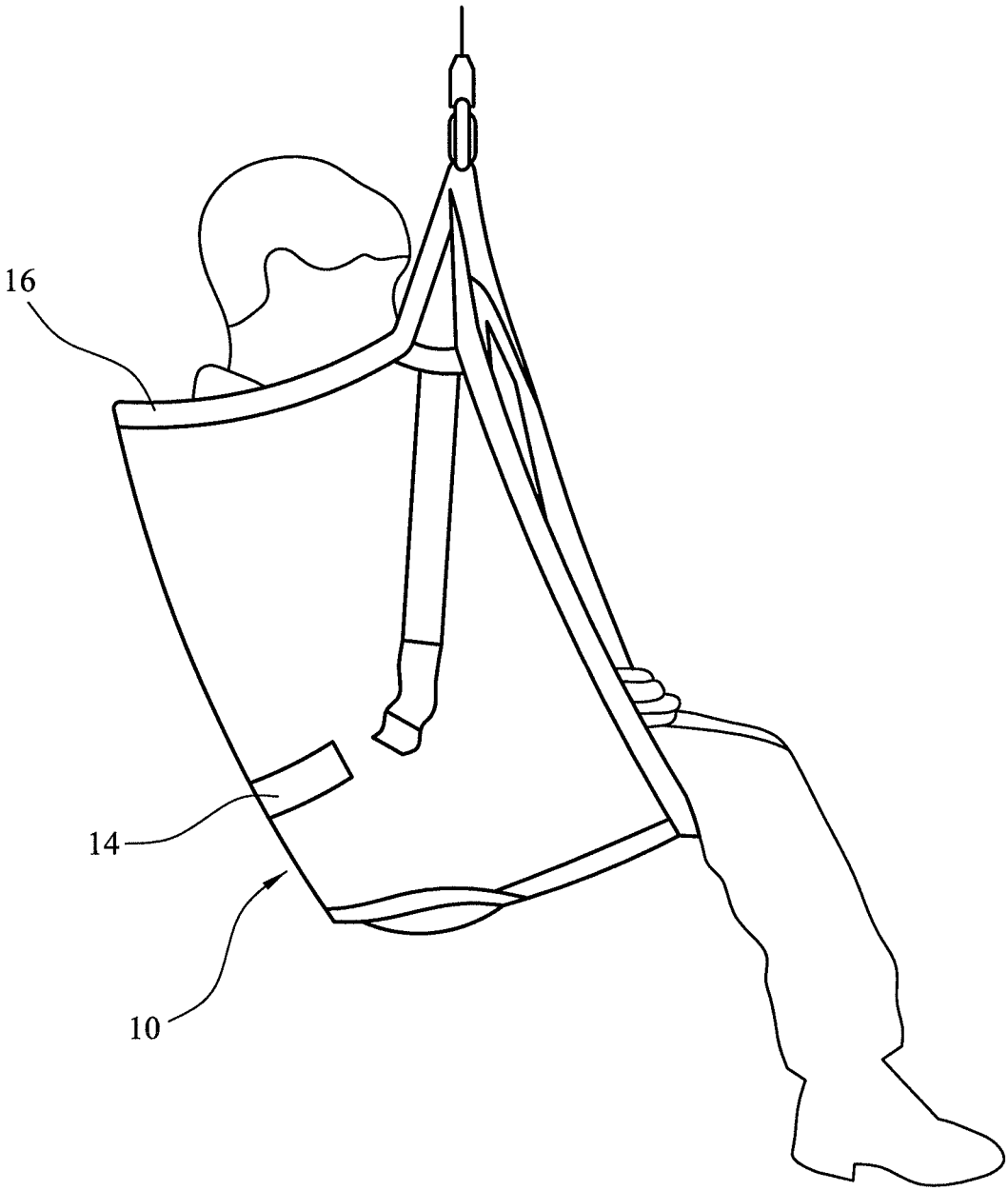
FIG. 1 is an illustration of a sling in use.

FIG. 1 illustrates a sling 10 that provides an upright sitting posture and supports the entire back of a patient up to the shoulders. A sling of this type is just one example of a fabric-based patient support device that can be laundered and re-used. Other examples of patient support devices of this type include support vests, straps and lift sheets. These devices are available in different sizes and made from different fabrics.

Figure 2:
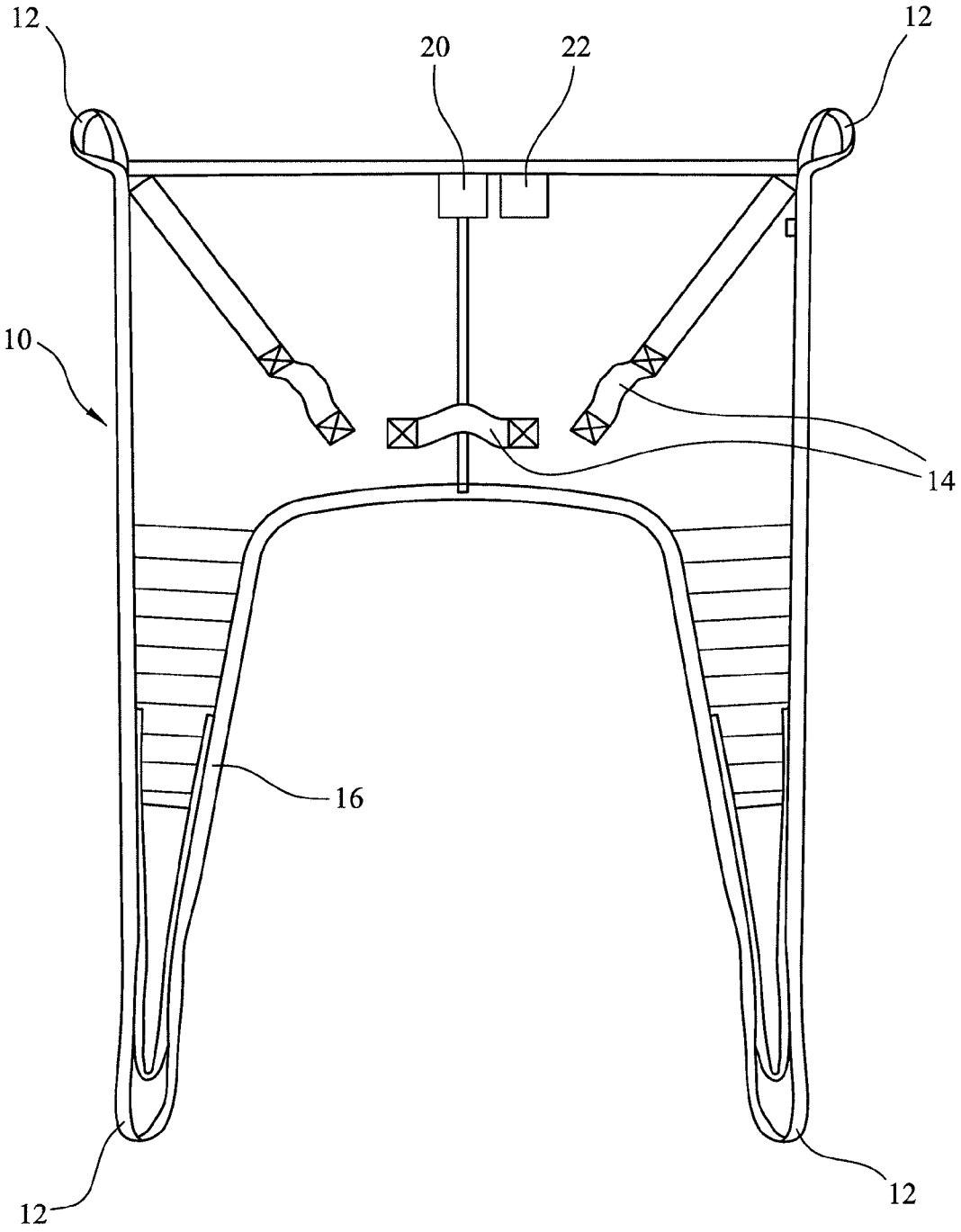
FIG. 2 is an illustration of the sling of FIG. 1, showing the position of a label for recording dates of first use.

FIG. 2 is an illustration of the sling shown in FIG. 1, when not in use. It can be seen that the sling can be laid out flat and has various loops 12 for attachment to lifting devices and handles 14 to allow a patient to be maneuvered. The main body of the sling 10 is formed from polyester fabric, which is durable and has suitable friction, making the sling easy to apply and remove, yet without being too slippery. The loops and edging is also formed from durable polyester. A sling of this type is available from Liko AB, Nedre vägen 100, SE-975 92 Luleå, Sweden as the UniversalSling.

The sling 10 includes several labels, of which two labels 20, 22 are visible in FIG. 2. The labels 20, 22 are secured between the main body of the sling and the edging 16. The first label 20 provides details of the product. Protected underneath the product label 20 are other labels, also secured between the main body of the sling and the edging, such as the date of manufacture, and the serial number, and an individual marking label. The second label 22 is provided to inform users to perform regular inspection of the sling. It could also be a label to allow users to record the date of first use and/or to record the date of periodic inspections of the sling. Other labels may be provided underneath or on top of label 22.

Figure 3:
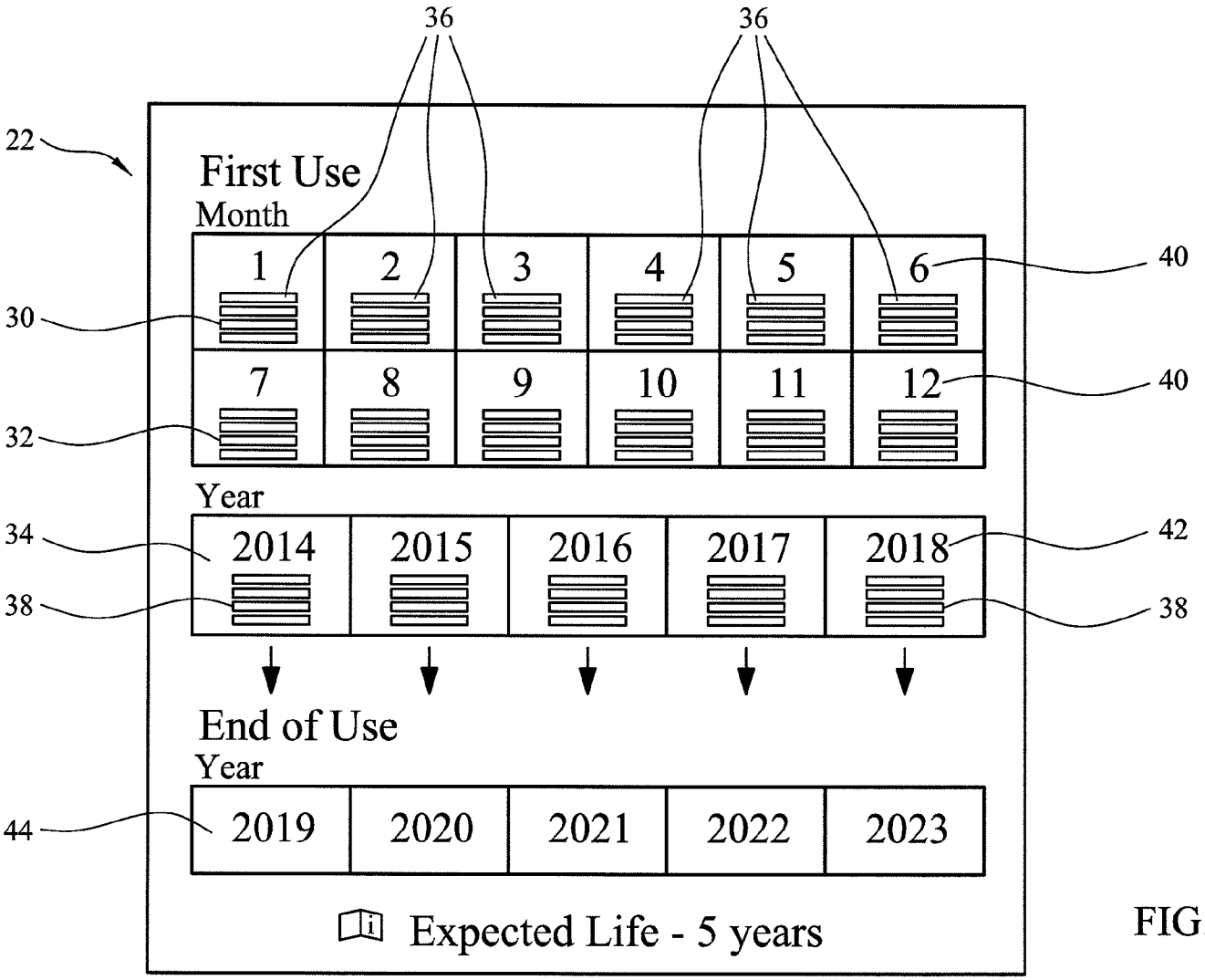
FIG. 3 is an illustration of the label before use.

FIG. 3 shows a portion of the label 22 in more detail. The label 22 is also formed of polyester. As can be seen, date markers are provided on the label for indicating a date of first use of the device and a corresponding end of use date. Month markers 40 run from 1 to 12. Year markers 42 run from 2014 to 2018. The date markers 40, 42 are formed from thread woven into the label. The words on the label, such "end of use", "month" and "year" are also woven into the label.

Adjacent each of the date markers is a severable portion 36, 38 of an indicator element 30, 32. As shown in FIG. 3, three indicator elements 30, 32 and 34 are provided, each indicator element having a plurality of severable portions 36 which are visible in FIG. 3. The indicator elements are formed from a plurality of parallel threads. Fixing portions of the indicator elements (not visible in FIG. 3) are woven into the label at positions between the severable portions 36 so that the indicator elements are securely fastened to the label. Each indicator portion is secured at at least three points between each severable portion and on either side of each of the outermost severable portions. The fixing portions are protected from excessive wear by folding the label and fixing the ends of the label on either side of the fold to the main body in the same position. A date of first use can be indicated by cutting a severable portion 36 of an indicator element 30, 32, indicating a month and cutting a severable portion of an indicator element 34, indicating a year.

It is of course possible to have a different arrangement of indicator elements. For example, the month markers 40 may be provided in a single row and a single indicator element having twelve severable portions may be provided adjacent the row. Alternatively, more than two indicator elements may be used each having fewer than six severable portions. Similarly, the year may be indicated by more than one indicator portion. It is also possible to include further date markers and indicator elements for indicating a week or a day and it is possible to include a larger number of years.

In this example, each of the indicator elements are formed by a plurality of green polyester threads which are clearly visible against the white polyester background of the label. Each thread has a plurality of fibers. Using a plurality of these threads and fastening points (in this example at least 3) for each severable portion means that even if some of the fibers break or slip out during the laundry process, the recording of the date of first use is still robust and reliable. The numbers for the month and the years and the writing on the label are provided by black threads woven into the label.

The label includes an end of use indication 44. In this example the device has an expected life of five years so that underneath each year marking in the first use section there is a year in the end of use section which is five years after the corresponding year in the first use section. This allows a user to easily see when the device should be taken out of service, even if no defects are found on inspection of the device. The end of use indication is also provided by black thread woven into the label.

Figure 4:
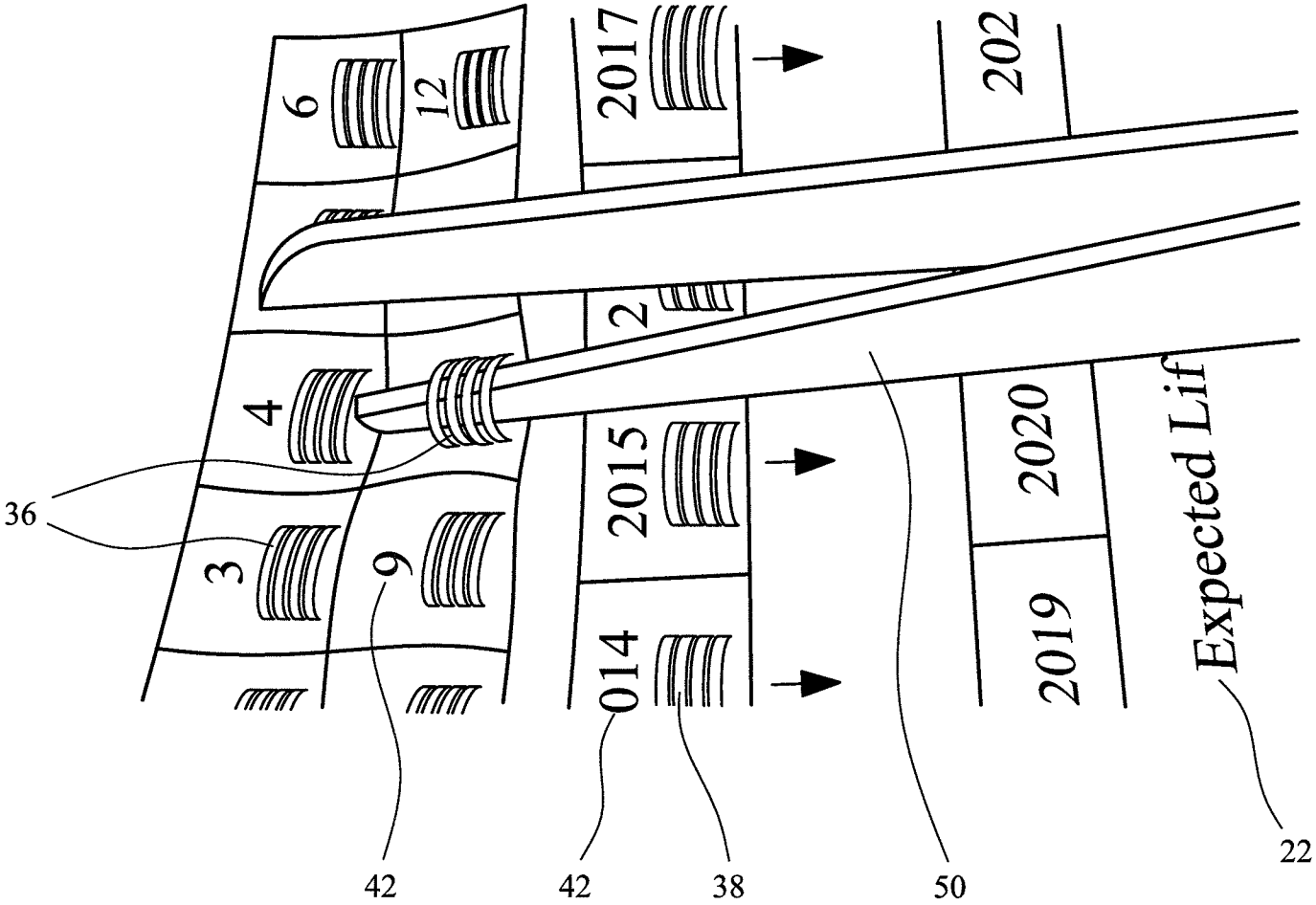
FIG. 4 is an illustration of the label being cut using a pair of scissors.

FIG. 4 more clearly shows how the label of FIG. 3 is used. FIG. 4 is a perspective view of the label showing a pair of scissors 50 inserted underneath one of the severable portions 36. The severable portion 36 being cut is positioned adjacent to month marker number 10. If the scissors are used to cut this severable portion, it would indicate that the device was first used in the month of October. It can be seen that the severable portions are long enough to allow a blade of a pair of scissors to be inserted between the severable portion and the label, allowing the severable portion to be cut easily without the need to use special cutting equipment.

Figure 5:
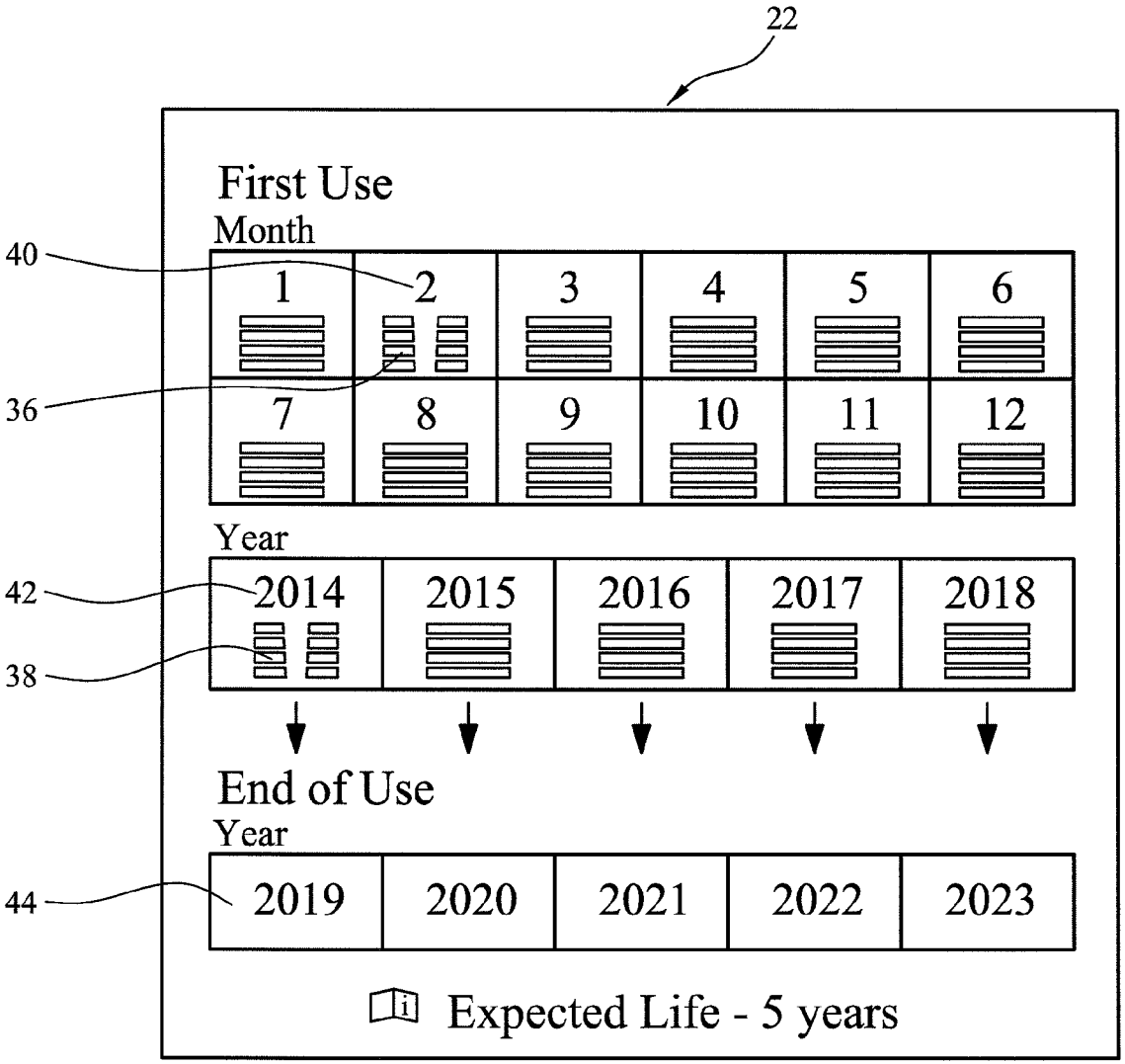
FIG. 5 is an illustration of the label during use.

FIG. 5 shows the label of FIGS. 3 and 4 after first use. In the example shown in FIG. 5, it can be seen that the severable portions 36, 38 corresponding to February and 2014 have been cut. So the device to which the label is attached was first used in February 2014 and, as the device has a five year service lifetime, the end of its service lifetime will be in February 2019.

The same basic method for recording information on the sling or other load bearing fabric device can be used for other purposes. For example, typically a sling must be periodically inspected at least once every six months, and possibly more frequently if the device has been washed more than usual. It is desirable to be able to record that a periodic inspection has taken place. A label of the type shown in FIGS. 3, 4 and 5 can be used for this purpose. Each time a periodic inspection has been carried out, one or more severable portions associated with a date marker on a label of the type shown in FIG. 3 can be cut to permanently record the date of inspection.

Figure 6:
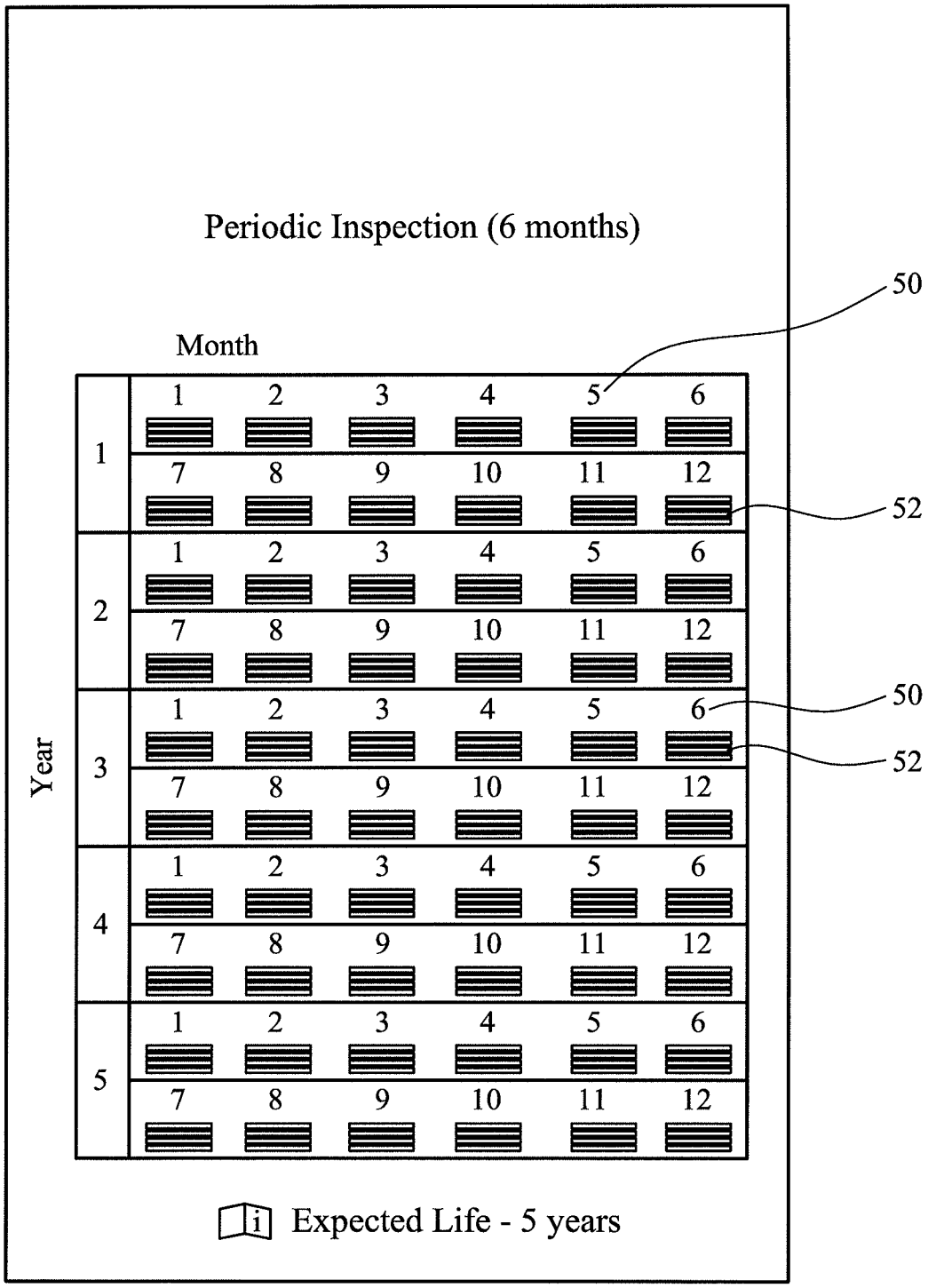
FIG. 6 is an illustration of a label for recording the dates of periodic inspections.

FIG. 6 is an illustration of a label (or a portion of a label) for recording the date of periodic inspections of a sling of the type shown in FIGS. 1 and 2. The sling has a service lifetime of 5 years from the date of first use. As indicated on the label shown in FIG. 6, the sling should be inspected every six months. The twelve months of the year for each of 5 years are marked on the label by date markers 50. The date markers and the words and grid lines shown in FIG. 6 are provided by threads woven into the fabric of the label. Adjacent to each month marker 50 is a severable portion 52 of an indicator element of the type described with reference to FIGS. 3, 4 and 5. The indicator elements are formed from a plurality of parallel threads. Fixing portions of the indicator elements (not visible in FIG. 6) are woven into the label at positions between the severable portions 52 so that the indicator elements are securely fastened to the label. Each indicator portion is secured at at least three points between each severable portion and on either side of each of the outermost severable portions. In this example, each of the indicator elements are formed by a plurality of green polyester threads which are clearly visible against the white polyester background of the label.

To record the date of an inspection, a user simply cuts a severable portion 52 corresponding to the month in which the inspection took place. The user can refer to a date of first use label of the type shown in FIG. 3 if required to determine the correct severable portion to cut.

The date markers and indicator elements of FIG. 6 can be provided on the same label as the date of first use markers and indicator elements as shown in FIG. 3, or may be provided on a separate label, or on the body of the device.

Although the indicator elements have been described as woven into the label in the examples described, it is also possible for the indicator elements to be fixed in another way, such as being sewn, knitted or welded to the label or directly to the main body of the fabric device. Illustratively, the severable portions of the indicator elements are spaced from the underlying label and main body of the device so that severing the severable portions does not damage the labels or main body of the device in any way.

Although the label and device as described with reference to the drawings is one from polyester, it is possible to use cotton, polyamide, polypropylene or other plastics or textiles or combinations of these. Similarly, although the indicator elements have been described as being formed of a plurality of threads, they might be formed from a single webbing element or ribbon that is able to withstand the wear from repeated washing.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles have been presented, they need not be utilized in combination, and various combinations of inventive aspects and principles are possible in light of the various embodiments provided above.

The invention claimed is:

1. A patient lifting apparatus for lifting a patient, the patient lifting apparatus comprising:

a textile main body configured as a sling or lift sheet for supporting the patient while lifted, and one or more indicator elements on the textile main body, or on a label fixed to the textile main body, and date information being situated adjacent the one or more indicator elements, the indicator elements comprising a plurality of severable portions spaced from the main body or the label on which they are provided, each of the severable portions being associated with a particular month or year of the date information such that by cutting one or more of the severable portions a date of use of the device or a date of inspection of the device is indicated.

2. The patient lifting apparatus of claim 1, wherein the one or more indicator elements are woven into the textile main body or the label.

3. The patient lifting apparatus of claim 1, wherein the date information comprises a number.

4. The patient lifting apparatus of claim 3, wherein the date information is separate to and positioned adjacent to at least one of the severable portions.

5. The patient lifting apparatus of claim 4, wherein the date information is woven into the textile main body or into the label on which the indicator elements are provided.

6. The patient lifting apparatus of claim 3, wherein the date information indicates months and years.

7. The patient lifting apparatus of claim 1, wherein the indicator elements are fixed to the textile main body or the label.

8. The patient lifting apparatus of claim 1, wherein each of the indicator elements comprises a plurality of threads.

9. The patient lifting apparatus of claim 1, wherein each severable portion of each indicator element comprises a loop material.

10. The patient lifting apparatus of claim 1, wherein at least one of the indicator elements is associated with month information and at least one other indicator element is associated with year information.

11. The patient lifting apparatus of claim 1, further comprising a plurality of end of life markers, each end of life marker being associated with a date marker.

12. A method for indicating a date of first use of a patient lifting apparatus, the patient lifting apparatus being in accordance with claim 1, the method comprising: cutting one or more of the severable portions to provide an indication of the date of first use of the device or the date of inspection of the device.

13. The patient lifting apparatus of claim 1, further comprising a plurality of loops coupled to the textile main body and adapted to be attached to a lifting apparatus.

14. The patient lifting apparatus of claim 13, wherein each loop of the plurality of loops is located near an outer edge of the textile main body.

15. The patient lifting apparatus of claim 13, wherein the plurality of loops comprise portions of edging attached to an outer edge of the textile main body.

16. The patient lifting apparatus of claim 13, further comprising handles coupled to the textile main body and spaced from the plurality of loops.

* * * * *